US005385870A

United States Patent [19]

Maue et al.

[11] Patent Number: 5,385,870

[45] Date of Patent: Jan. 31, 1995

[54] DETACHABLE ELECTRICAL PLUG CONNECTION

[75] Inventors: Hans-Heinrich Maue, Bietigheim-Bissingen; Werner Hofmeister, Mühlacker; Willi Gansert, Kornwestheim; Thomas Heide, Essen, all of Germany

[73] Assignee: Robert Bosch GmbH, Stuttgart, Germany

[21] Appl. No.: 50,104

[22] PCT Filed: Aug. 14, 1992

[86] PCT No.: PCT/DE92/00682

§ 371 Date: May 3, 1993

§ 102(e) Date: May 3, 1993

[87] PCT Pub. No.: WO93/05549

PCT Pub. Date: Mar. 18, 1993

[30] Foreign Application Priority Data

Sep. 3, 1991 [DE] Germany ..... 4129236

[51] Int. Cl.[6] ..... H01R 13/629

[52] U.S. Cl. ..... 439/157

[58] Field of Search ..... 439/152–160

[56] References Cited

U.S. PATENT DOCUMENTS

| | | | |
|---|---|---|---|
| 3,488,622 | 1/1970 | Gley | 439/157 |
| 3,534,320 | 10/1970 | Rushing | 439/157 |
| 3,575,685 | 4/1971 | Gley | 439/157 |
| 4,035,634 | 7/1991 | Hasircoglu et al. . | |
| 4,307,505 | 11/1981 | Jozens . | |

*Primary Examiner*—Eugene F. Desmond

[57] ABSTRACT

A detachable electrical plug connection, particularly for connecting a cable harness to an engine control device in a motor vehicle, has at least two connection parts including at least one spring connector provided with contact carrier strips and at least one blade connector provided with contacts, and a locking device drawing the contacts of the blade connector into the contact carrier strips of the spring connector. The locking device includes a locking lever provided at one of the connection parts and swivelable around a point of rotation and is provided with a projection. The locking device also includes a connecting link provided on another of the connection parts so that the projection cooperates with the connecting link.

14 Claims, 8 Drawing Sheets

DETACHABLE ELECTRICAL PLUG CONNECTION

BACKGROUND OF THE INVENTION

The present invention relates to a detachable electrical plug connection, particularly for connecting a cable harness with an engine control device in a motor vehicle.

In particular, it relates to such a plug connection which has a spring connector and a blade connector with a locking mechanism drawing the contact of the blade connector into the contact of the spring connector.

When producing electrical plug connections it is desirable that the part designated as the female plug connector or spring connector may be easily connected with a male plug connector part, also known as a blade connector. In so doing, it is essential that the forces to be applied for producing the plug connection are not so great as to prevent the connection from being produced manually. On the other hand, the force required for separation must also not be too great so that the electrical plug connection can also be detached again without the help of tools.

Finally, the plug connection should also hold together securely and make contact during vibrations. Plug connections are known in which e.g. approximately 90 contacts are closed and in which the spring connector is brought into contact with the blade connector by a swiveling movement. However, this results in a relatively large lift region, i.e. a considerable amount of space is required for producing or detaching the plug connection. Also, the cable harness connected with the spring connector must be provided with a so-called bending loop or guard so that the bending strain on the cable to be guided into the spring connector is not excessive. Finally, it is disadvantageous that only blade contacts can be used in such plug connections.

Plug connections in which the two plug-connector parts are engaged by a parallel movement are also known. However, this has proven disadvantageous in that a relatively great expenditure of force is required to produce the electrical connection.

SUMMARY OF THE INVENTION

Accordingly, it is an object of the present invention to provide a detachable electrical plug connection which avoids the disadvantages of the prior art.

In keeping with these objects and with others which will become apparent hereinafter, one feature of the present invention resides, briefly stated, in a detachable electrical plug connection in which the locking mechanism has a locking lever at a part of the plug connection, which locking lever can be swiveled around a point of rotation, is provided with a projection and cooperates with a connecting link provided on the other part of the plug connection.

When the detachable electrical plug connection is designed in accordance with the present invention, it is advantageous compared to the prior art on the one hand in that it ensures a parallel insertion of the two plug connector parts so as to avoid the aforementioned disadvantages with respect to the swiveling connection of two plug connector parts. On the other hand, it ensures a detachable electrical connection which is comfortable, i.e. can be produced with a relatively small expenditure of force, and reliable and is used particularly for producing electrical connections between cable harnesses and an engine control device. It is especially advantageous precisely for this purpose in that it ensures a reliable contacting which is easy both to produce and detach.

It is possible to limit the forces required for producing and detaching in that a locking mechanism with a locking lever is provided on a part of the plug connection. The length and lever ratios of the locking lever can easily be adapted to the occurring forces. The locking lever is provided with a projection which cooperates with a connecting link provided on the complementary part of the electrical plug connection. Thus, the locking mechanism can be realized in a simple and accordingly inexpensive manner. Moreover, it is practically trouble-free.

In a particularly preferred embodiment form of the plug connection the connecting link has a stop bevel which swivels the locking lever out of an optional initial position into a favorable position for the locking process when the two plug connector parts are joined. The locking lever can accordingly be swiveled into an optimal actuating position already when joining the two plug connector parts, the contacts associated with the plug connection not yet being engaged, so that the forces required for this process are reduced to a minimum.

In another preferred embodiment example the connecting link has a first guide surface which is associated with the locking process. To complete the plug connection, the locking lever is swiveled out of its initial position into a locking position, its projection sliding along at the first guide surface of the connecting link or bearing. Because of the shaping of the guide surface, the forces required for locking can be adjusted. This also applies in a corresponding sense to a second guide surface of the connecting link along which the projection of the locking lever slides when swiveled in the opposite direction for detaching the connection.

In another preferred embodiment form of the plug connection, the connecting link or the housing region of the plug connector part at which the locking lever is arranged has a locking device. This ensures that the locking lever remains in its locked position. This is particularly advantageous when used in motor vehicles where high vibration forces tend to promote a detachment of the electrical plug connection.

An appropriate design of the connecting link prevents forces acting on the spring connector from bringing about a loosening moment on the lever locking mechanism.

In a particularly preferred embodiment form of the plug connection, the first guide surface which serves for locking extends in such a way that different moments occur when the locking lever is swiveled. For example, the moments required for swiveling the lever can be adjusted in such a way that only small forces are required at the start of the locking process, then greater forces are required when joining the two plug connector parts, and then only small forces are required again at the end of the locking process. Because of the changing moment during the closing process, the user can easily determine that the locking process is concluded. It can be easily recognized that the plug connection has been made correctly only when the locking lever is in its end or locking position.

In another preferred embodiment form of the plug connection the blade connector has different regions which are preferably provided with different numbers and different types of contacts so that modular cable harnesses can be connected with the respective device, particularly an engine control device, in a simple manner by means of the proposed plug connection.

Finally, in a preferred embodiment form of the plug connection the spring connector has a grip shell receiving at least two contact carrier strips which can be connected with one another. The contact carriers are held together in a particularly secure manner due to this construction so that a miniaturization of the contact carrier can be effected without loss of stability on the one hand and the respective cable is very reliably prevented from being pulled out of the plug connection.

Further advantages of the invention follow from the rest of the subclaims. A special advantage consists in that the locking mechanism can be constructed in such a way that the locking lever can be arranged on either the male or female plug connector part so that the plug connection can be used universally.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Following is a description of a construction type in which a locking lever is arranged on a grip shell of a plug connection. When the locking lever is arranged on the so-called male plug connector part located opposite the grip shell, the construction features described in the following are arranged in a corresponding manner, i.e. "in reverse".

Figure 1:
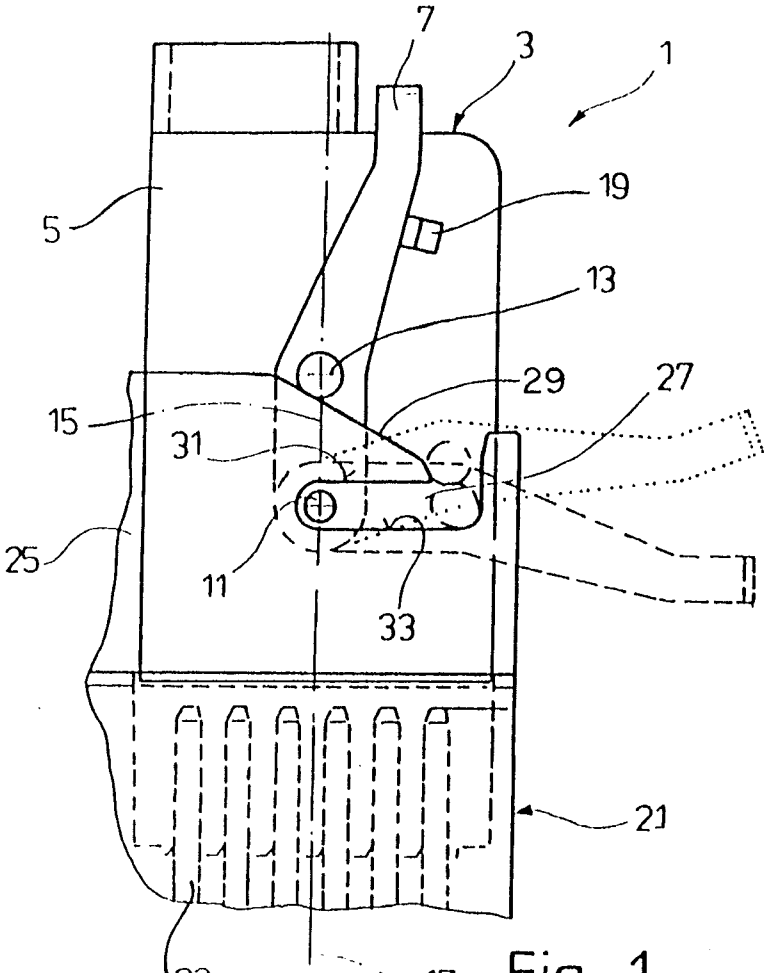

FIG. 1 shows a side view of a plug connection 1 immediately after joining the female and male plug connector parts. The female plug connector, designated in the following as spring connector 3, has a grip shell 5 which forms a kind of housing for this plug connector part. The cables associated with the spring connector are not shown in this figure for the sake of clarity.

A locking lever 7 of a locking mechanism 9 which serves to produce a secure plug connection is provided at the front side of the grip shell. The locking lever is supported so as to be swivelable around an axle stub 11 which projects out on the outside of the grip shell 5. A projection 13 which is arranged at a distance from the axle stub 11 projects out on the surface of the locking lever 7 facing the observer.

The connecting line 15 between the axle stub 11 and the projection 13 coincides with the vertical line 17 intersecting the axle stub 11 in FIG. 11. That is, the angle $\alpha$ enclosed by the connecting line 15 and the vertical line 17 is 0° in this case. A locking protuberance 19 projects away from the outside of the grip shell 5 facing the observer.

Two further positions of the locking lever 7 are shown in dots and dashes respectively in FIG. 1. This will be discussed in more detail in the following.

The male plug connector of the plug connection 1, designated in the following as blade connector 21, is shown here only in section. Other regions are broken off in the drawing. In the following it is given that the blade connector can have different types of contacts. A plurality of round pins 23 are shown in FIG. 1 by way of example. However, blades of various widths or posts can also be used. This will be discussed further in the following.

The blade connector 21 has a housing portion 25 which receives and guides the grip shell 5 of the spring connector 3. The aforementioned contacts or round pins 23 are arranged below this portion and fastened in the blade connector in a suitable manner, e.g. cast in one piece. A connecting link 27 which is part of the locking mechanism 9 can be seen in the upper region of the housing portion 25. It cooperates with the projection 13 on the locking lever 7. A stop bevel 29 on which the projection 13 rests when the two plug connector parts of the plug connection 1 are first joined is clearly visible. The connecting link 27 also has a first guide surface 31 which forms the upper limit of the connecting link 27. A second guide surface 33 is formed by the lower defining surface of the connecting link 27. In the embodiment example shown in FIG. 1, the two guide surfaces extend parallel to one another and substantially horizontally, i.e. they enclose an angle of 90° with the vertical line 17. The second guide surface passes into a vertical region which forms a conical widening with the stop bevel 29 and accordingly a kind of inlet funnel for the projection 13.

In the position of the plug connection 1 shown in FIG. 1 the contacts of the blade connector 21 which are constructed in the present case as round pins 23 still contact the contact strips arranged in the interior of the grip shell 5, i.e. there is no electrical connection in this position.

Figure 2:
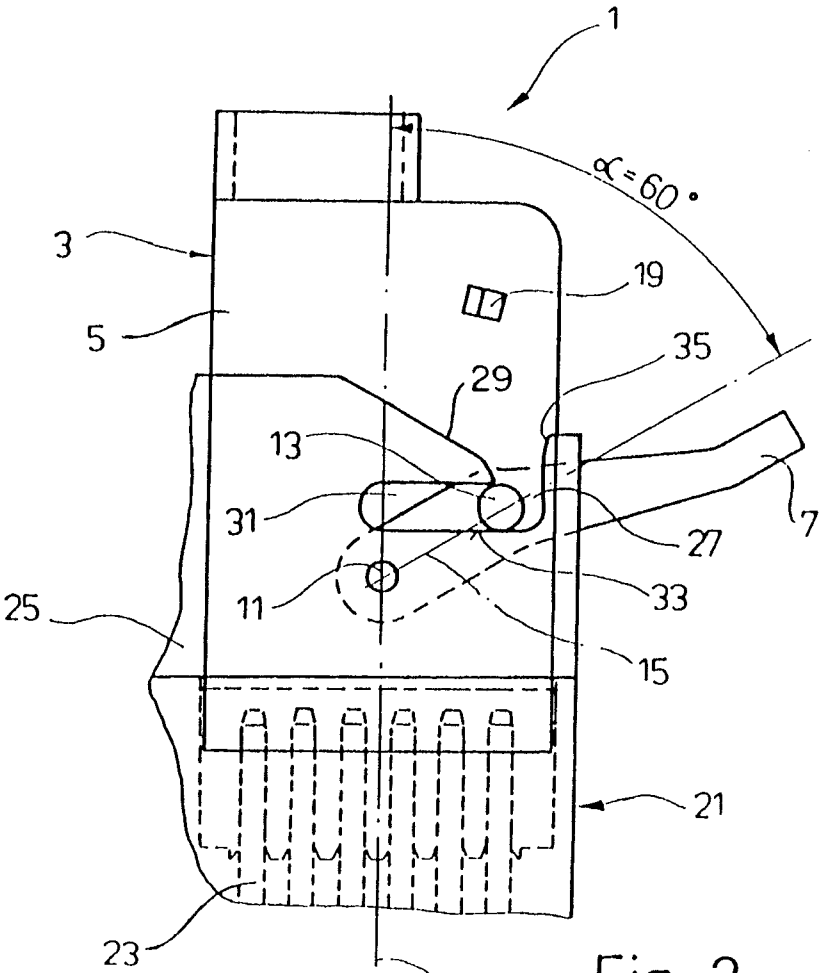
FIGS. 1 to 4 show a side view of a plug connection with different positions of the two plug connector parts and locking lever of the locking mechanism.

FIG. 2 is a side view of the plug connection 1 shown in FIG. 1. Identical parts are provided with the same reference numbers so that a detailed description thereof can be omitted.

The locking lever 7 is swiveled by an angle $\alpha$ of 60° relative to the position shown in FIG. 1. That is, the connecting line 15 between the axle stub 11 and the projection 13 on the locking lever 7 encloses an angle $\alpha$ of 60° with the vertical line 17. The projection is pressed through the inlet funnel 35 into a region of the connecting link 27 in which it contacts the first guide surface 31 as well as the second guide surface 33. The spring connector 3 is pushed further into the blade connector 21 compared to FIG. 1. The round pins 23 first contact the contact carriers inside the grip shell 5 in this position.

The spring connector 3 must be pressed into the blade connector 21 manually to arrive in the position according to FIG. 2. In so doing, the projection 13 slides along the stop bevel 29. The locking lever 7 must be lifted over the locking protuberance 19 if necessary.

Figure 3:
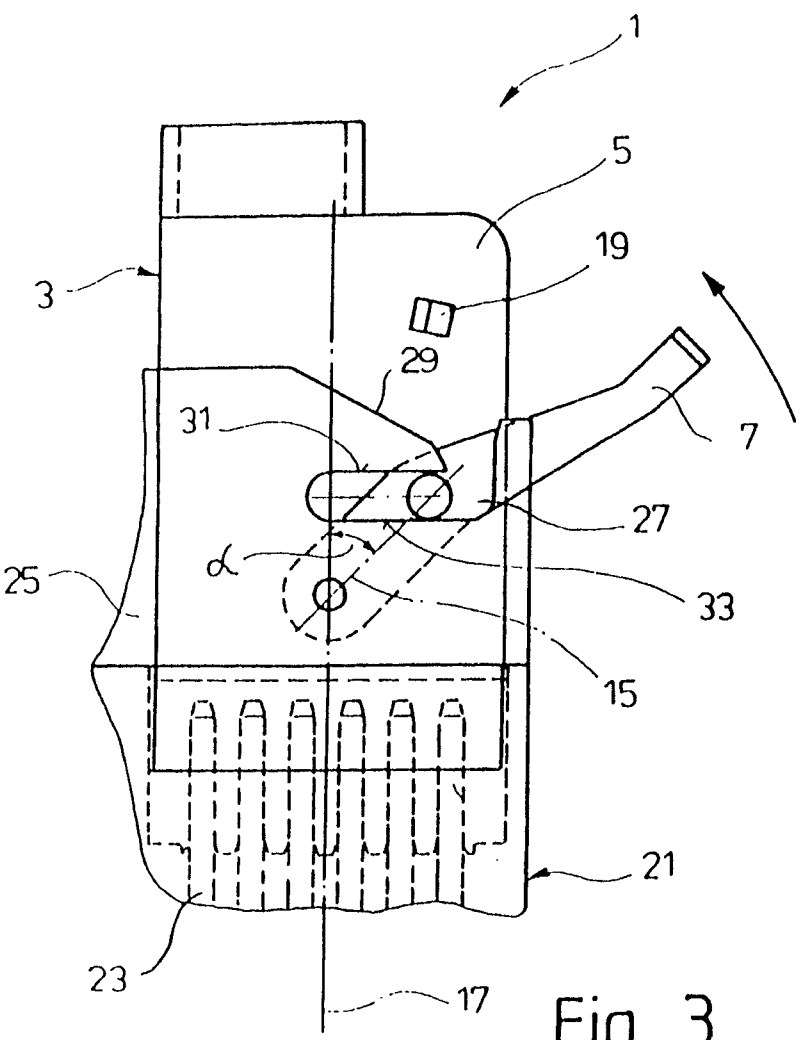

FIG. 3 shows the same plug connection 1. Identical parts are again provided with the same reference numbers so that a description thereof can be omitted.

Compared to the view in FIG. 2, the locking lever 7 has been swiveled up so that the angle $\alpha$ enclosed between the connecting line 15 and the vertical line is less than 60°. During the swiveling movement in the direction of the arrow shown in FIG. 3 the projection 13 slides along the first guide surface 31 and is supported thereon. The spring connector 3 is accordingly pressed further into the blade connector 21 so that the round pins come more and more into contact with the contact carrier arranged in the interior of the grip shell 5.

The spring connector 3 is thus drawn further and further into the blade connector 21 by the swiveling movement of the locking lever 7.

Figure 4:
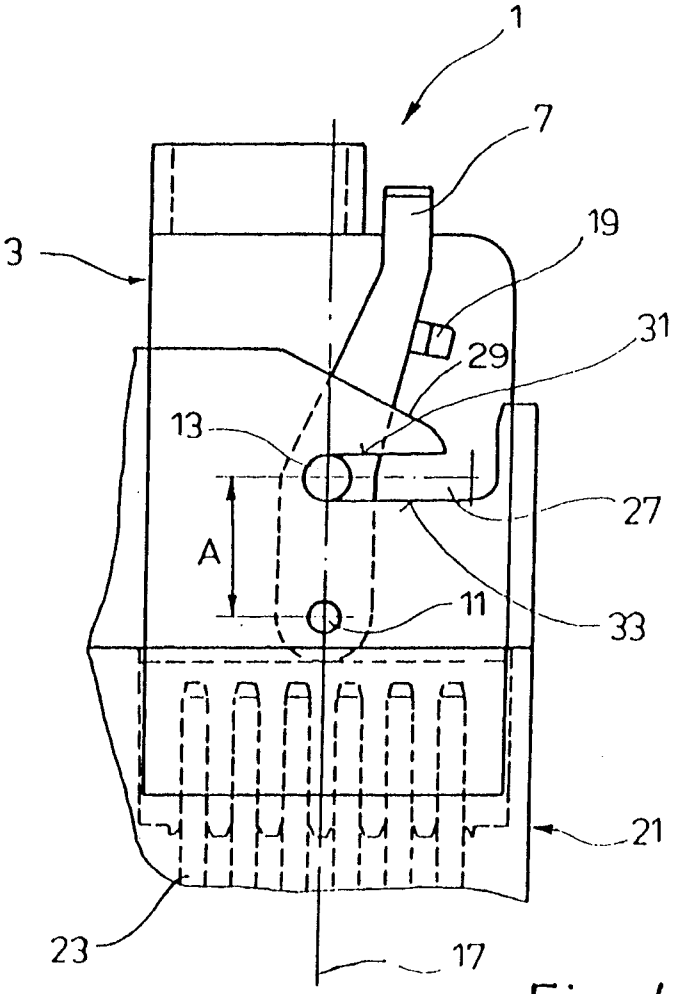

Finally, the end position of the spring connector 3 inside the blade connector 21 is achieved as shown in FIG. 4. In this end position the locking lever 7 is so arranged that the connecting line 15 encloses an angle $\alpha$ of 0° with the vertical line 17. In this locking position, the locking lever 7 lies on the other side of the locking protuberance 19 so as to rule out unintentional unlocking.

In addition to the locking protuberance 19, a recess 37, shown in dots, can be provided in the first guide surface 31, the projection 13 coming to rest in this recess 37 in the locking position of the locking lever 7 so as to provided additional protection against unlocking. The recess 37 lies above the projection 13 when the locking lever 7 encloses an angle $\alpha$ of 0° with the vertical line 17.

In this position, shown in FIG. 4, the round pins 23 serving as contacts have secure electrical contact with the contact carriers arranged in the grip shell 5 and with contact springs inserted into the latter.

The lift of the locking movement during the swiveling of the locking lever 7 is determined by the swivel angle $\alpha$ and by the distance A between the projection 13 and the axle stub 11.

Figure 5:
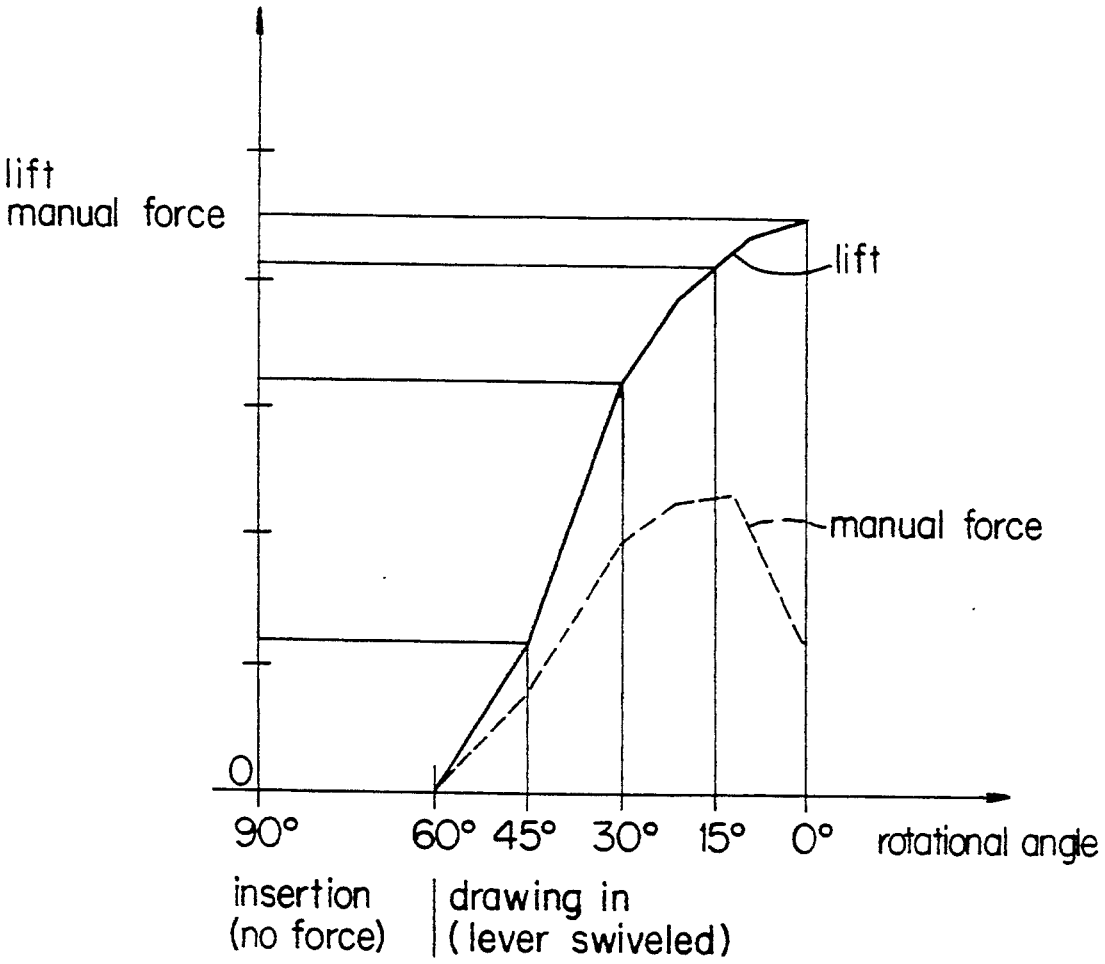
FIG. 5 shows a graph of the lift and manual force over the rotational angle of the locking lever.

In FIG. 5, the lift caused by a swiveling movement of the locking lever 7 and the manual force required for this is shown over the rotational angle of the locking lever 7. It is assumed that the swivel angle $\alpha$ is 90° when the connecting line 15 is perpendicular to the vertical line 17, i.e. when it extends horizontally with respect to the latter as shown in FIG. 1. It has already been mentioned above that the position in which the angle $\alpha$ has the value of 0° is achieved when the locking lever 7 is arranged in its end position according to FIG. 4.

Angular positions for 90°, 60°, 45°, 30°, 15° and 0° are shown by way of example in FIG. 5. While the spring connector 3 is slid into the blade connector 21 manually, the locking lever 7 moves out of the position shown in dashes in FIG. 1 into the position shown in FIG. 2. Thus, it is swiveled out of the position in which $\alpha=90°$ into the position in which $\alpha=60°$, although no locking forces are exerted on the locking lever 7. This displacement is thus a pure reaction to the plugging in of the two plug connector parts.

If the locking lever 7 is now manually swiveled out of its initial position at $\alpha=60°$ in the direction of the arrow shown in FIG. 3, it is clear according to FIG. 5, that the manual force shown in dashed lines slowly increases while the lift, i.e. the displacement of the spring connector 3 inside the blade connector 21, likewise increases. While the lift increases in a roughly continuous manner, the manual force to be exerted on the locking lever 7 reaches its maximum at approximately $\alpha=15°$ and then drops quickly.

Thus the user can easily determine from the reaction force of the locking lever 7 that the locking process is concluded. The locking position of the locking lever 7 can also be seen distinctly according to FIG. 4. It is also clearly noticeable when the locking protuberance 19 is passed so that a secure locking is ensured. A complete insertion of the spring connector 3 into the blade connector 21 is guaranteed, since it is only then that the end position of the locking lever 7 can be achieved.

In order to open the plug connection 1 the locking lever 7 must be swiveled in the opposite direction and lifted over the locking protuberance 19. During the unlocking movement of the lever the projection 13 is supported on the second guide surface 33 of the connecting link 27. In the embodiment example shown here, the two guide surfaces extend parallel to one another. However, it is also possible to provide a different curving of the second guide surface and accordingly to achieve a different lifting movement when the plug connection 1 is opened. During the swiveling movement of the locking lever 7 in the counterclockwise direction, the projection 13 moves to the right into the slot defined by the guide surfaces until the first guide surface 31 can no longer prevent the projection 13 from moving forward. Since the projection 13 is supported on the lower, second guide surface 33, a force is exerted on the spring connector 3 which lifts the latter out of the blade connector 21 until the relative position of the spring connector 3 shown in FIG. I is finally reached with respect to the blade connector 21. The spring connector can then be drawn out of the blade connector without applying great force. Thus, no tools are required for detaching the plug connection.

When locking the plug connection 1, the spring connector 3 is displaced substantially parallel to the blade connector 21. In larger spring connectors, a plurality of locking devices can also be provided and actuated more or less simultaneously.

Corresponding locking levers—shown in FIGS. 1 to 4—can also be provided on the rear of the spring connector 3 to increase the locking forces. The locking levers arranged on the two sides of the spring connector can also be connected with one another so as to form a kind of locking clip. In this way, very great contact forces as well as great unlocking forces can be applied.

Figure 6:
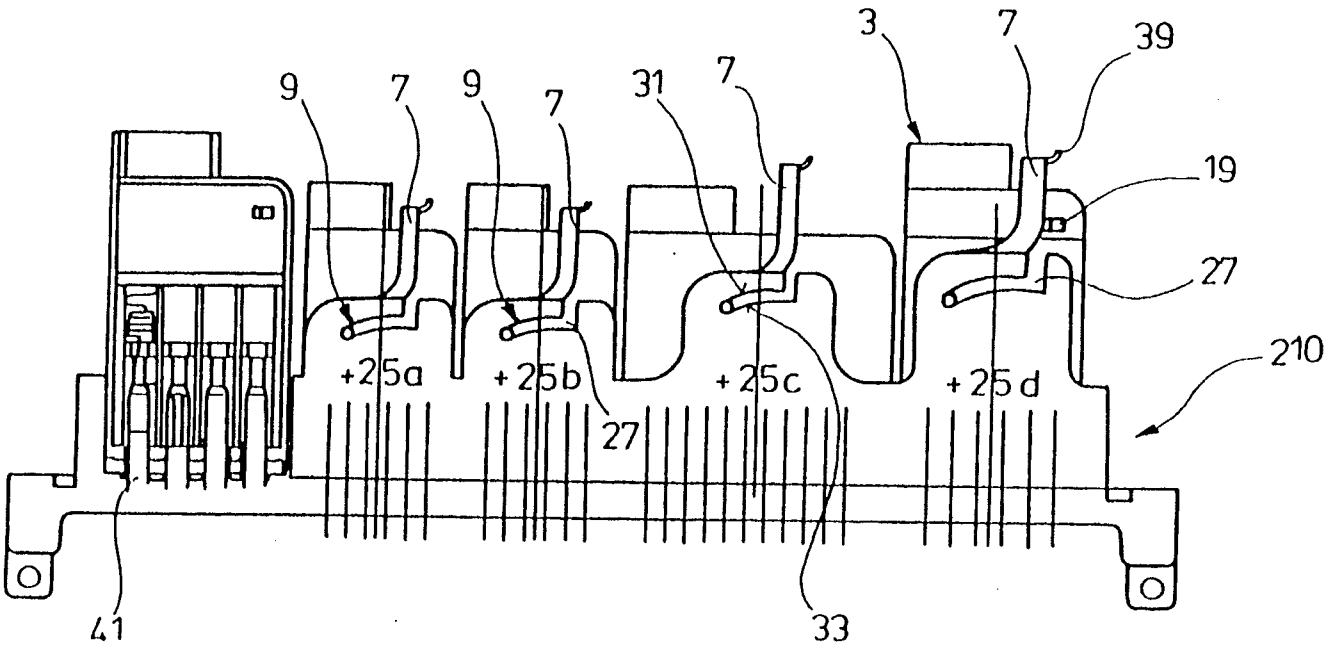
FIG. 6 shows a side view of a plug connection with a male plug connector receiving a plurality of female plug connectors.

FIG. 6 shows a number of adjacent plug connections as were discussed in general with reference to FIGS. 1 and 5. The blade connectors 210 which are shown here and serve as male plug connectors are distinguished from one another by a plurality of housing portions **25*a*, 25*b*, 25*c*, 25*d* arranged side by side. A female plug connector, or spring connector 3, is associated with each of these housing portions. The construction of the individual spring connectors can vary. As can be seen from FIG. 6, not only the width, but also the height of the spring connectors can be constructed differently. In the embodiment example shown here each spring connector is associated with its own locking lever 7 which cooperates with a corresponding connecting link. The two opposite guide surfaces 31 and 33 associated with the projection 13** describe an arc portion in this instance. In this case, the shaping of the guide surfaces is again adapted to the desired lift and to the actuating moment during the locking process.

Only the spring connector at the far right is provided by way of example with a locking protuberance 19 on the outside of its housing. The locking protuberance 19 holds the locking lever 7 in its end position as shown in FIG. 4. Of course, the particular construction of the lever 7 has no effect on the locking function. In this instance, gripping brackets 39 are provided at the end of the lever. The female connector shown at the far left in FIG. 6 is constructed in such a way that it cooperates with contacts of the blade connector 210 which are constructed as blades 41.

Figure 7:
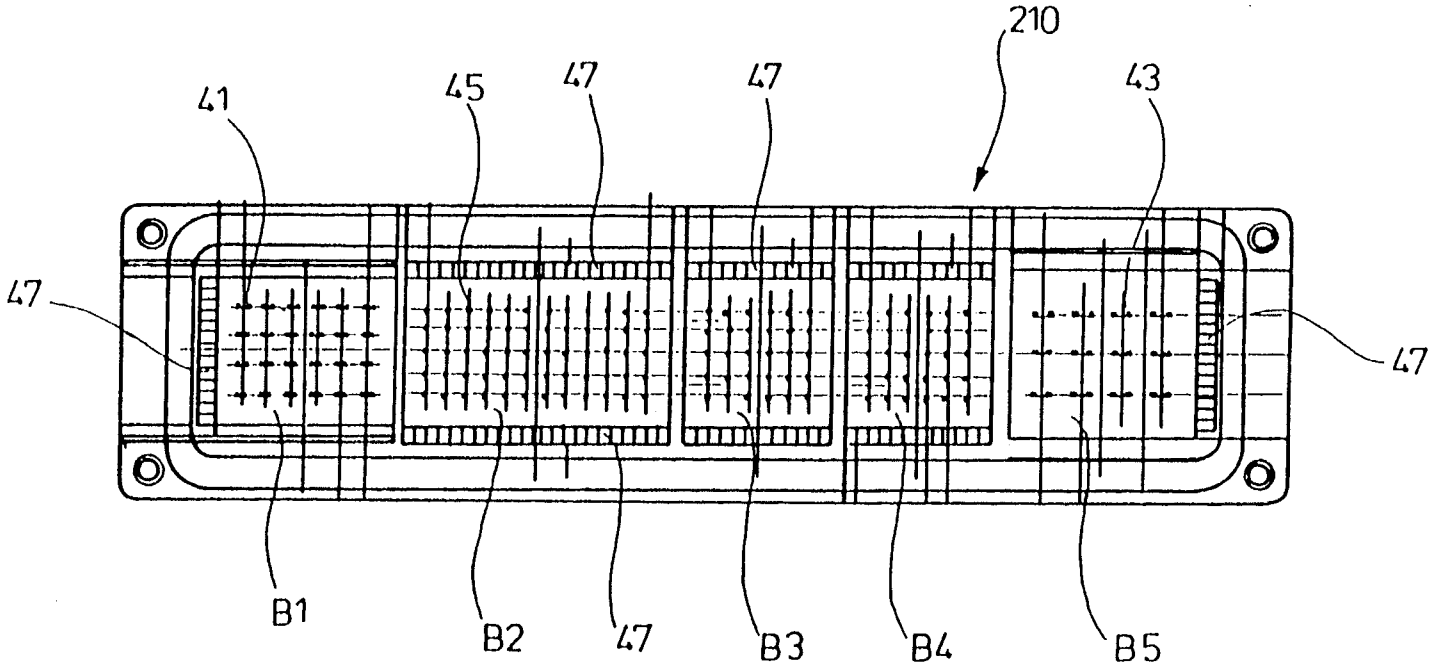
FIG. 7 shows a top view of the male plug connector and the blade connector shown in FIG. 6.

It is clear from the top view shown in FIG. 7 that the blade connector 210 is characterized by different regions B1, B2, B3, B4, B5 which are distinguished from one another in this case e.g. by various types of contacts and also by the quantity of selected contacts. Blade contacts 41 are provided in region B1 at left. These blade contacts 41 have a different width than the blade contacts 43 in region 5. Round pins or posts 45 are provided as contacts in the remaining regions B2, B3 and B4.

Three rows of contacts arranged one above the other are provided in region B1. Four rows of contacts arranged one above the other are provided in regions B2 to B5. The number, shape and arrangement of contacts can be varied optionally as a result of the parallel movement of the plug connector parts during the locking process. In this way, different spring connectors can be predetermined for the different contact regions of the blade connector 21. Breakaway regions 47 are indicated in dashed lines in FIG. 7. Different grooves can be formed in the latter at predetermined locations by breaking away. These grooves can cooperate with projections on the underside of the spring connectors. In this way the spring connectors and respective regions of the blade connector can be mechanically coded to prevent defective contact. It can be seen from FIG. 6 that the gripping brackets 39 can also be constructed so as to prevent the insertion of an adjacent female plug connector at a swivel angle $\alpha$ of 90°. In this way, the sequence for introducing the spring connectors into the blade connector 210 can be predetermined. This can also be ensured by protuberances on the outside of the spring connectors which, when appropriate, abut against the grip shell of adjacent spring connectors and prevent insertion in the event of deviation from the prearranged plug-in sequence.

The individual spring connectors can also have more than one locking mechanism in the plug connection described with reference to FIGS. 6 and 7. For example, longer spring connectors can be provided with two locking levers arranged on one side. Such locking mechanisms can also be arranged on two opposite longitudinal sides of the female plug connector.

Due to the fact that the spring connectors undergo a parallel displacement relative to the blade connector when manually inserted as well as when subsequently locked, optional contact shapes can be used as follows from FIG. 7. The lift region required for producing the electrical connection is substantially smaller than in the case of a swiveling movement of the spring connectors. A bending guard of the respective cable harness can also be dispensed with.

It can be seen in particular from FIG. 6 that a modular-type cable harness can be securely connected with a corresponding contact location so as to be electrically conducting. In so doing, individual cable strands associated with different regions of the blade connector can be electrically connected.

When appropriate, the sequence in which the individual spring connectors are connected can be predetermined as described above. A plug-in sequence can be predetermined for both closing and opening the connection. FIG. 7 shows that a miniaturization of the contacts is possible. For example, a large number of contacts are provided at a distance from one another in region B4. High contact forces are applied by the locking mechanism so that a comfortable and reliable connection is ensured in this case.

Due to the parallel displacement of the plug connector parts individual electrical contacts can be constructed so as to lead or lag by predetermining the length of the individual electrical contacts, so that some contacts can make electrical contact sooner than others when producing the electrical connection.

As described with reference to FIGS. 1 to 4, stop bevels can also be provided in the individual connecting links in the embodiment example according to FIG. 6. These stop bevels ensure that when assembling the plug connector parts manually the locking lever is guided from an optional initial position into the inlet funnel of the connecting link and occupies its initial position which subsequently enables a secure locking when the lever is swiveled.

In the embodiment example according to FIG. 6 it is also possible to predetermine the moment curve of the manual force at the locking lever through the selection of the connecting link. In particular, a slight manual force is desired when initially opening and when sliding the contact springs onto the (male) pins or blades. This results in a so-called degressive moment region. The contacts will then be quickly slipped on in the contact region with a medium manual force on the locking lever. The female plug connectors are favorably guided into the respective housing regions of the male plug connector so that there is also no risk of tilting during the greater moment required for this. This region is called the progressive region.

Finally, a degressive region in which only slight moments are to be applied is reached again shortly before the end position of the locking lever. In this swiveling region of the locking lever a secure locking of the plug connector parts and lever is achieved. A final pressing force can also be applied, for example. This presses firmly against a seal provided between the plug connector parts so as to achieve an electrical connection which is sealed against moisture.

The above-mentioned contact carrier strips which are arranged in the interior of the grip shell 5 will be described in more detail with reference to FIGS. 8*a* and 8*b*. Due to the high locking forces, four rows of contacts can be provided inside the spring connector or grip shell. A first contact carrier strip 51 and a second contact carrier strip 53 have two rows of contacts in each instance. The recesses 55 in the contact carrier strips serving to receive the contacts are separated from one another by a dividing wall 57.

The right-hand side wall 59 of the first contact carrier strip 51 is provided with a locking projection 61 having two horizontal wall regions 65 and 67 which are connected with one another by a vertical wall region 63 and extend so as to be offset in height relative to one another. In a corresponding manner, the left-hand side wall 69 of the second contact carrier strip has a locking protuberance 71 having horizontal wall regions 75 and 77 which are connected by a vertical wall region 73 and are likewise arranged so as to be offset in height relative to one another. The horizontal regions 65 and 75 of the contact carrier strips proceeding from the side wall are again offset with respect to height relative to one another, while the horizontal wall regions 67 and 77 proceeding from the vertical wall regions 63 and 73, respectively, are arranged at approximately the same height.

The right-hand wall 59 of the first contact carrier strip 51 is provided with a recess 79 immediately below the horizontal wall portion 65. Another recess 81 is located below the latter. Recesses 85 and 87 are provided in the left-hand wall 83 opposite the recesses 79 and 81.

A recess 89 is provided directly above the horizontal wall region 75 of the locking mechanism 71 of the second contact strip 53 in the left-hand wall 69 of the latter, and another recess 91 is provided directly below this wall region. Recesses 93 and 95 are provided in the right-hand wall 97 of the second contact carrier strip 53 opposite the recesses 89 and 91.

The recesses 79 and 89 in the side walls 59 and 69 are continuous, i.e. they extend in the longitudinal direction of the contact carrier strips 51 and 53. In contrast, the locking mechanisms 61 and 71 of the contact carrier strips 51 and 73 can be constructed as a locking comb.

Figure 9:
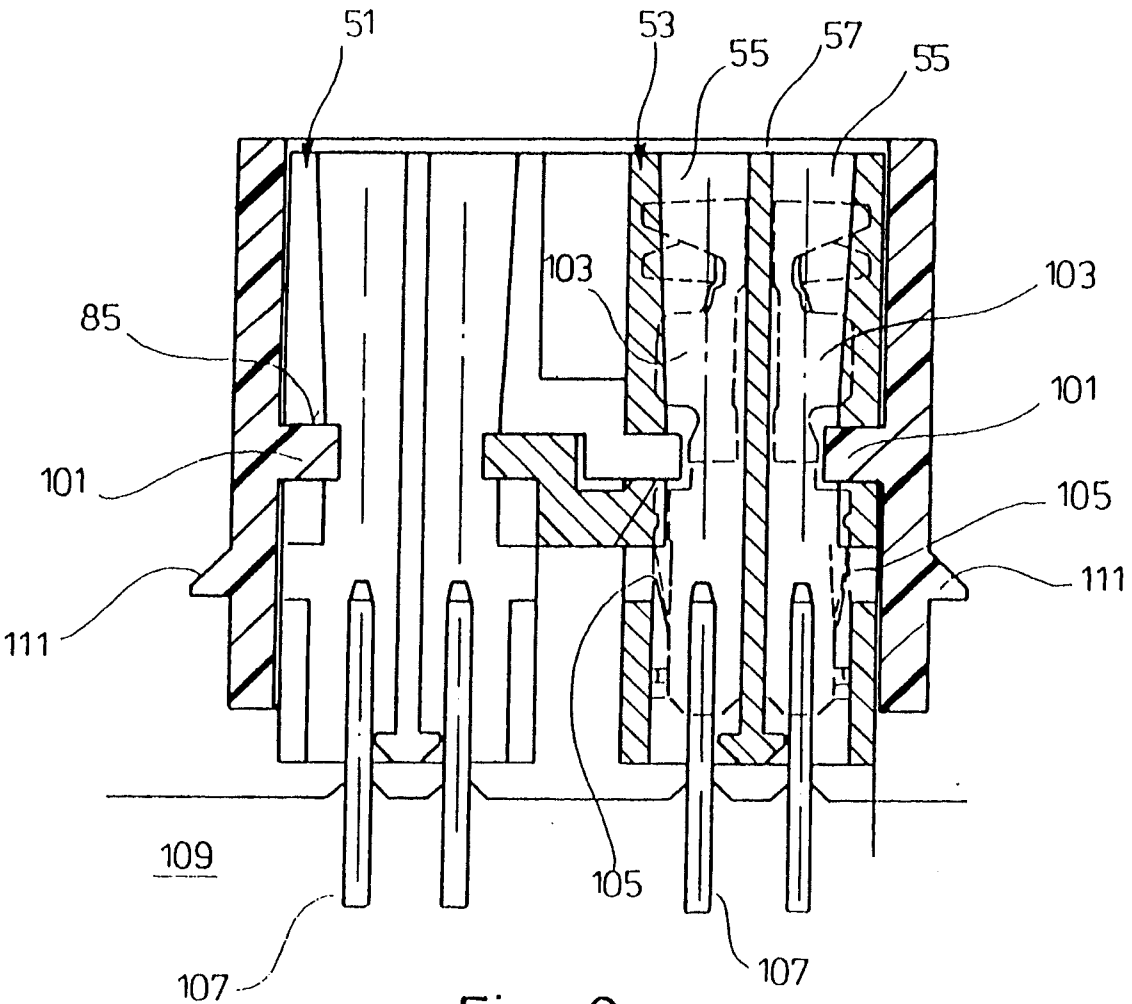
FIG. 9 shows a side view of the contact carrier strips shown in FIG. 8 in the assembled state.

In this way it is ensured that a positively locking connection can be produced between the first contact carrier strip 51 and the second contact carrier strip 53 in that the two parts are slid one inside the other by longitudinal displacement relative to one another as is shown in FIG. 9. Identical parts are provided with the same reference numbers so that a detailed description thereof can be dispensed with.

The vertical and horizontal wall regions of the locking mechanisms 61 and 71 are dimensioned and adapted to one another in such a way that a positive engagement is ensured when the two contact strips are inserted one inside the other and a relative displacement of the contact carrier strips vertically with respect to the displacement direction is prevented. Thus, the contact carrier strips can be moved up and down only jointly. The distance between the contact carrier strips can also no longer be increased after locking. Thus, there results on the whole a bond of high dimensional stability, which is particularly important because high locking forces can be reached in the plug connection described above. It should be noted that more than two adjacent contact carrier strips can be locked together in this way.

A further stabilization of the contact carrier strips is achieved by a strengthening or reinforcing device 99, shown in FIG. 9, which is slid over them, its inner dimensions being selected in such a way that the contact carrier strips which are securely connected with one another contact the inner wall of the reinforcing device. In so doing, projections 101 proceeding from the inner wall project into the recesses 85 and 93 in the left-hand wall 83 of the first contact carrier strip 51 and in the right-hand wall 97 of the second contact carrier strip 53. A vertical displacement of the reinforcing device 99 relative to the contact carrier strips 51 and 53 is reliably prevented in this manner since the height of the projections is adapted to the height of the recesses 85 and 93.

Contact elements 103 are inserted into the recesses 55 of the second contact carrier strip 53. These contact elements 103 engage in the recesses 91 and 95 in the walls 69 and 97 of the second contact carrier strip 53 with springing locking catches 105 and are by this means secured against a longitudinal displacement inside the recesses 55. Such contact elements produced from springing metal are known-as is their assembly inside the contact carrier strips-and need not be discussed in more detail.

Corresponding contact elements are also inserted into the first contact carrier strip 51. For the sake of clarity, they are not shown here.

To clarify the manner of operation FIG. 9 also shows contacts 107 of a blade connector 109, the latter only being suggested in the drawing.

Projections 111 which lock into suitable recesses in a grip shell 5 which is slipped over the constructional unit shown in FIG. 9 are provided on the outside of the reinforcing device 99. The projections 111 lend a secure support to this constructional unit inside the grip shell resulting in a very stable spring connector.

Figures 8A, 8B:
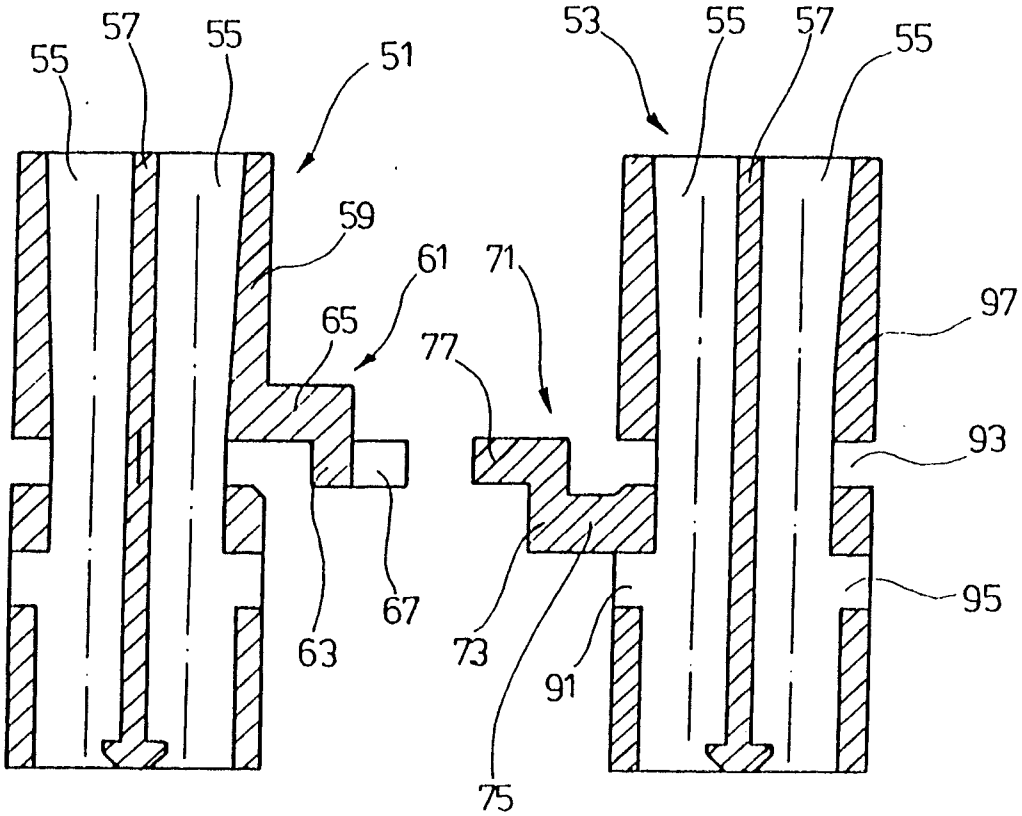
FIGS. 8*a* and 8*b* show two separate contact carrier strips which can be locked together.

As a whole, it can be seen that with the aid of the contact carrier strips shown in FIGS. 8*a* and 8*b* and the reinforcing device shown in FIG. 9 a spring connector of great dimensional stability can be produced which can reliably absorb the high reaction forces caused by locking. Due to the positively locking connection between the contact carrier strips, four adjacent rows of contacts can easily be electrically connected with a male plug connector in a secure manner.

The contact carrier strips are securely connected with one another in such a way that they are securely joined already as a constructional unit according to FIG. 9. Cable connections inserted into the contact carrier strips can be guided together through a corresponding recess in the grip shell 5 so that the latter has no need of additional openings and a moisture-tight plug connection can also ultimately be produced. An embodiment example of such a connection is shown in cross section in FIG. 10.

The plug connection 1', as female plug connector part in accordance with the preceding description, has a spring connector 3' and a blade connector 21' as male plug connector part. The latter is again provided with four adjacent rows and contacts 107 which engage in recesses 55' of a contact carrier strip 151 constructed in one piece. Contacts, not shown in detail in this figure, can be secured inside the contact carrier strip 151 by a known displaceable plate 153.

A housing portion 5' of the grip shell projects into the housing portion 25' of the blade connector 21', the length of the two portions as measured in the vertical direction being adapted to one another in such a way that the underside of the housing portion 5' of the spring connector 3' compresses a seal 155 in the assembled state of the plug connector parts so as to be tight against moisture, the seal 155 being arranged in the base of the blade connector 21'.

As was described in detail with reference to FIGS. 1 to 5, the spring connector 3' is connected with the blade connector 21' by a locking mechanism, not shown here. Locking mechanisms 5'' which engage by means of suitable projections 5''' in recesses 25'' on the outside of the housing portion 25' are also provided here.

The cables of a cable harness which are associated with the spring connector 3' can be securely connected with the contacts, not shown here, and can then be anchored in the contact carrier strip 151 by the locking plate 153. The grip shell 5 of the spring connector 3' is then slid over the preassembled contact carrier strip. No additional recesses are needed in the spring connector 3' for the attachment of cables of any kind so that a moisture-tight electrical plug connection can easily be realized.

In all, it can be seen that a detachable electrical plug connection which reliably intercepts the forces occurring during the locking of the two plug connector parts can be realized without the help of tools. It is also easy to detach the two plug connector parts from one another by actuating the locking lever. As a result of the construction of the locking mechanism which has a connecting link cooperating with a projection provided on the locking lever, high unlocking forces can be applied so that the contacts of the blade connector are effortlessly pulled out of the contact carrier strips of the spring connector. The respective parts of the plug connection can then be pulled apart manually.

Figure 10:
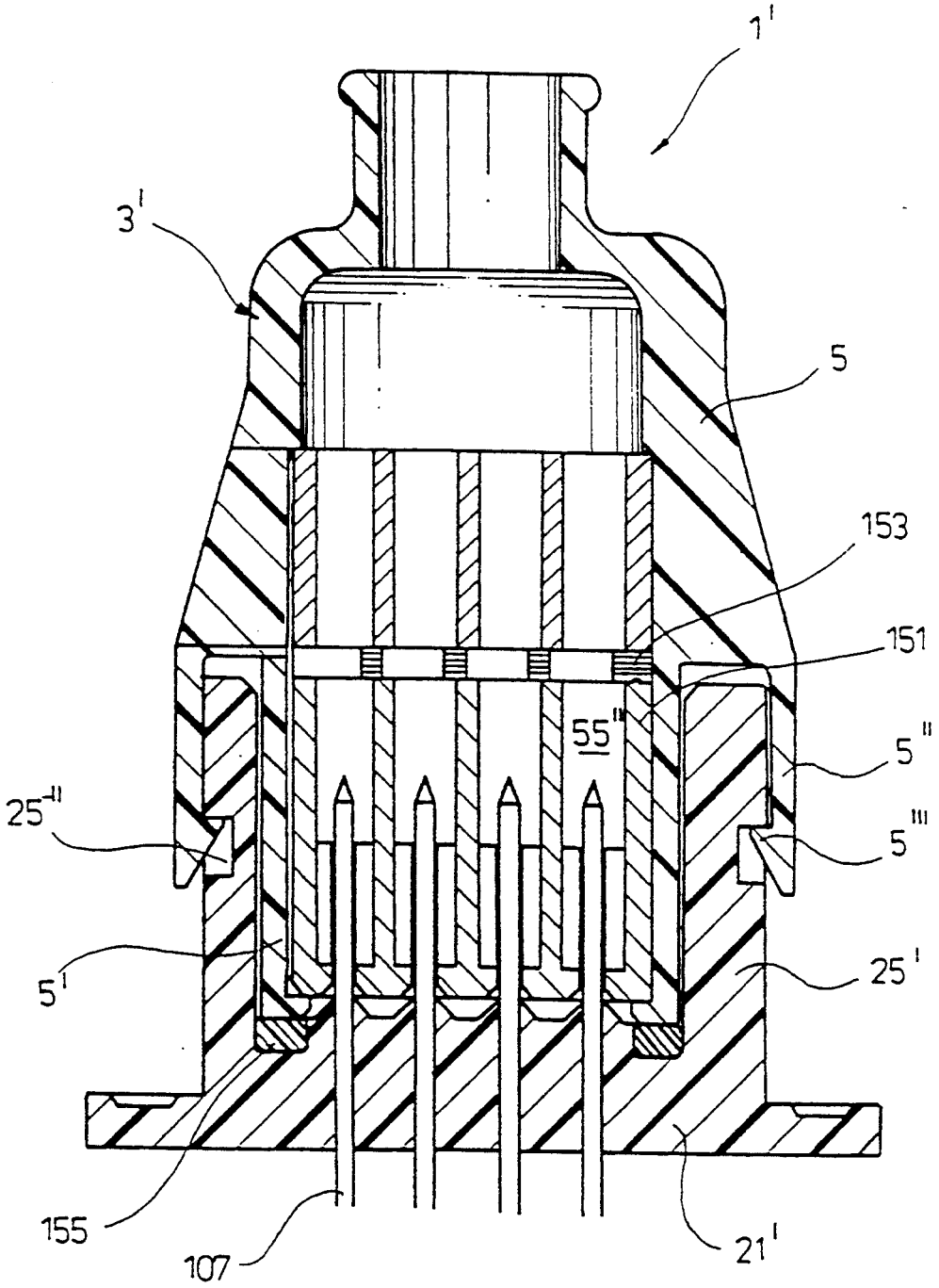
FIG. 10 shows a section through another embodiment example of a plug connection.

Finally, it can also readily be seen that individual spring connectors can also be constructed so as to be tight against moisture as was explained with reference to FIG. 10 in a blade connector as shown in FIG. 6. Modular cable harnesses with sensitive contact regions can accordingly have individual moisture-tight contacting locations.

It will be understood that each of the elements described above, or two or more together, may also find a useful application in other types of constructions differing from the types described above.

While the invention has been illustrated and described as embodied in a detachable electrical plug connection, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A detachable electrical plug connection, particularly for connecting a cable harness to an engine control device in a motor vehicle, the connection comprising at least two connection parts including at least one spring connector provided with contact carrier strips and at least one blade connector provided with contacts; locking means drawing said contacts of said blade connector into said contact carrier strips of said spring connector, said locking means including a locking lever provided at one of said connection parts, said locking lever being swivelable around a point of rotation and provided with a projection, said locking means also including a connecting link provided on another of said connection parts so that said projection cooperates with said connecting link, said connecting link having a stop bevel by which said locking lever is swivelable into its initial position for locking when said spring connector and said blade connector are joined.

2. A plug connection as defined in claim 1, wherein said blade connector has different regions which are provided with different contacts and have at least one such locking means, said blade connector having individual regions which are mechanically coded.

3. A plug connection as defined in claim 2, wherein said different regions of said blade connector have different numbers of contacts.

4. A plug connection as defined in claim 2, wherein said different regions of said blade connector are provided with contacts of different shapes.

5. A plug connection as defined in claim 2, wherein said blade connector and said spring connector are formed so as to provide a predetermined plug-in sequence.

6. A plug connection as defined in claim 1, wherein Said blade connector, said spring connector and said locking means are formed so as to provide a predetermined plug-in sequence.

7. A plug connection as defined in claim 1, wherein said spring connector has a grip shell receiving at least two of said carrier strips which are lockable together.

8. A plug connection as defined in claim 7, wherein said carrier strips are provided on at least one longitudinal side with at least one projection and also provided with at least one longitudinal recess in which a locking projection engages.

9. A plug connection as defined in claim 8, wherein said recess is provided on a same longitudinal side on which said projection is provided.

10. A plug connection as defined in claim 8, wherein said recess is provided at an opposite longitudinal side opposite to said longitudinal side on which said projection is provided.

11. A plug connection as defined in claim 8, wherein said locking projections are formed so that said carrier strips are displaceable in a longitudinal direction relative to one another and tensile forces directed perpendicularly to them are absorbed by a positively locking engagement.

12. A plug connection as defined in claim 1, wherein said carrier strips have recesses accommodating contact springs in a locking manner.

13. A plug connection as defined in claim 1; and further comprising a separate reinforcing device which holds said carrier strips together.

14. A plug connection as defined in claim 13, wherein said spring connector has a grip shell provided with inner recesses, said reinforcing device having outer projections engaging in said recesses of said grip shell.

* * * * *